US008302938B2

(12) United States Patent
Ebeling

(10) Patent No.: US 8,302,938 B2
(45) **Date of Patent: *Nov. 6, 2012**

(54) RAILING SECTION WITH ADJUSTABLE FENCE MEMBERS

(76) Inventor: Cordell E. Ebeling, Isanti, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/690,350

(22) Filed: Jan. 20, 2010

(65) Prior Publication Data

US 2010/0181543 A1 Jul. 22, 2010

Related U.S. Application Data

(63) Continuation of application No. 11/546,773, filed on Oct. 12, 2006, now Pat. No. 7,673,853.

(51) Int. Cl.
*E04H 17/14* (2006.01)
*G09F 11/02* (2006.01)
*E06B 7/096* (2006.01)

(52) U.S. Cl. ..... 256/59; 256/1; 49/82.1; 40/505

(58) Field of Classification Search ..... 256/24, 256/26, 27, 67; 49/74.1, 82.1; 40/493, 503, 40/505; 74/89.2, 405, 411, 412 TA
See application file for complete search history.

(56) References Cited

U.S. PATENT DOCUMENTS

| | | | |
|---|---|---|---|
| 2,202,417 | A | 5/1940 | Fleming |
| 2,607,452 | A | 8/1952 | Hall |
| 2,618,087 | A | 11/1952 | Hutchison, Jr. |
| 2,789,792 | A | 4/1957 | Davis |
| 2,973,943 | A | 3/1961 | Loter et al. |
| 3,084,715 | A | 4/1963 | Scharres |
| 3,137,043 | A | 6/1964 | Moeller |
| 3,342,458 | A | 9/1967 | Simonton |
| 3,412,506 | A | 11/1968 | Masayoshi |
| 3,688,522 | A | 9/1972 | Schmuck |
| 3,724,812 | A | 4/1973 | Richardson |
| 4,099,346 | A | 7/1978 | Isono |
| 4,122,885 | A | 10/1978 | Marotto |
| 4,184,288 | A | 1/1980 | Magill et al. |
| 4,265,086 | A | 5/1981 | Bahrenburg |

(Continued)

FOREIGN PATENT DOCUMENTS

GB 2241000 A 1/2010

OTHER PUBLICATIONS

PCT/US2007/021584, Written Opinion dated Apr. 24, 2008.

(Continued)

*Primary Examiner* — Joshua Kennedy
(74) *Attorney, Agent, or Firm* — Merchant & Gould P.C.

(57) ABSTRACT

A railing section is capable of being adapted for varying conditions of use. The railing section includes first and second support rails. The first support rail has a longitudinal void. A plurality of movable fence members are perpendicularly disposed between the first and second support rails. A drive mechanism is disposed in the longitudinal void of the first support rail and coupled to the plurality of movable fence members. Operation of the drive mechanism causes simultaneous rotation of the movable fence members along longitudinal axes of the respective movable fence members through an angle 360 degrees or more. Two or more railing sections may be coupled together by a member that couples the respective drive mechanisms of the sections.

19 Claims, 14 Drawing Sheets

U.S. PATENT DOCUMENTS

| | | | |
|---|---|---|---|
| 4,275,762 | A | 6/1981 | Field |
| 4,469,216 | A | 9/1984 | Haataja et al. |
| 4,541,160 | A | 9/1985 | Roberts |
| 4,702,122 | A | 10/1987 | Richard |
| 4,703,188 | A | 10/1987 | Gottfried |
| 4,709,506 | A | 12/1987 | Lukaszonas |
| 4,773,464 | A | 9/1988 | Kobayashi |
| 4,938,445 | A | 7/1990 | Medley |
| 4,953,231 | A | 9/1990 | Burnett |
| 5,052,150 | A | 10/1991 | Chen |
| 5,095,966 | A | 3/1992 | Rogers |
| 5,203,394 | A | 4/1993 | Hailey |
| 5,216,837 | A | 6/1993 | Cleaver et al. |
| 5,292,086 | A | 3/1994 | Min |
| 5,297,353 | A | 3/1994 | Ghalayini |
| 5,315,776 | A | 5/1994 | Strawbridge et al. |
| 5,347,756 | A | 9/1994 | Abbott et al. |
| 5,469,658 | A | 11/1995 | Digianni et al. |
| 5,572,816 | A | 11/1996 | Anderson, Jr. et al. |
| 5,600,920 | A | 2/1997 | Roy |
| 5,628,494 | A | 5/1997 | Arnold |
| 5,887,386 | A | 3/1999 | Alexanian et al. |
| 6,027,104 | A | 2/2000 | Alexander et al. |
| 6,052,931 | A | 4/2000 | Werner |
| 6,126,145 | A | 10/2000 | Mohr |
| 6,128,857 | A | 10/2000 | Morgan et al. |
| 6,178,675 | B1 | 1/2001 | Strother |
| 6,269,568 | B1 | 8/2001 | Lo |
| 6,405,782 | B1 | 6/2002 | Cheng |
| 6,508,140 | B2 | 1/2003 | Zaps |
| 6,796,549 | B1 | 9/2004 | Lester |
| 7,025,335 | B2 | 4/2006 | Zhu |
| 7,032,891 | B2 | 4/2006 | Rowley et al. |
| 7,100,904 | B2 | 9/2006 | Kim |
| 7,281,353 | B2 | 10/2007 | Konstantin |
| 7,571,896 | B2 * | 8/2009 | Bonham ..... 256/27 |
| 2002/0157291 | A1 | 10/2002 | Lin |
| 2003/0159355 | A1 | 8/2003 | Froerer et al. |
| 2004/0140462 | A1 | 7/2004 | Rowley et al. |
| 2005/0193850 | A1 | 9/2005 | Sasaguchi et al. |
| 2007/0199216 | A1 | 8/2007 | Atkinson |

OTHER PUBLICATIONS

PCT/US2007/021584, International Search Report dated Apr. 24, 2008.

* cited by examiner

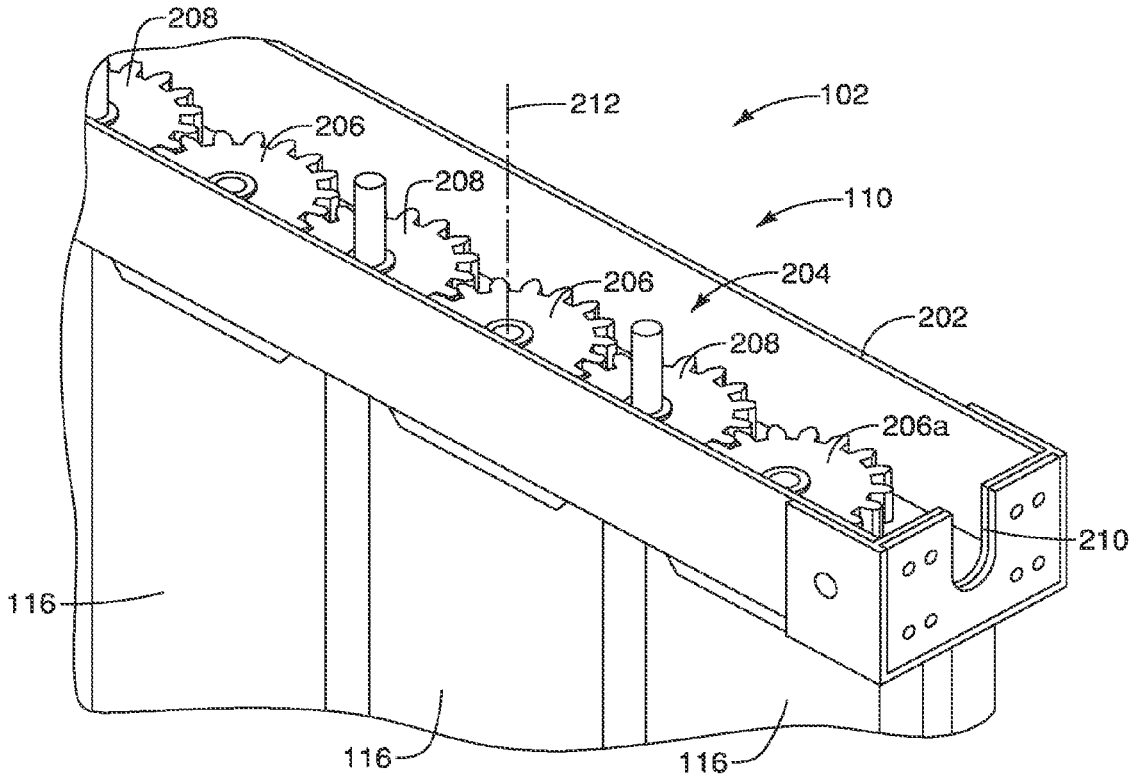
FIG. 2A
FIG. 2B
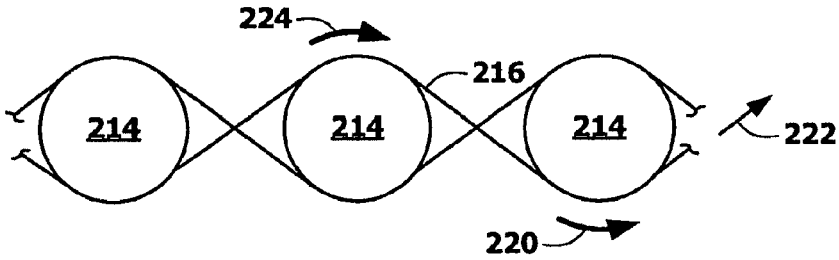
FIG. 2C
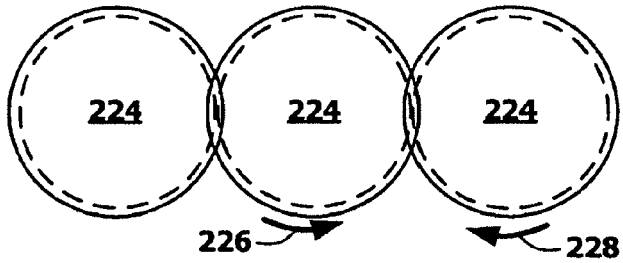

RAILING SECTION WITH ADJUSTABLE FENCE MEMBERS

FIELD OF THE INVENTION

This invention relates in general to outdoor containment structures, and more particularly to fencing systems having adjustable vertical support members adaptable to meet varying use conditions.

BACKGROUND

The home improvement industry has seen significant growth in the last decade. It is estimated that consumers spent over a quarter of a trillion dollars in 2005 on home improvement projects, and that number has been growing at a rate of about 7% per year. As a result, manufacturers and retailers spend significant effort in trying to differentiate their products from the competition.

One commonly undertaken home improvement project involves adding fences, railings, outdoor-rooms and similar structures to homes and landscaping. Railings and fences can be added for aesthetic reasons, such as to add interest to landscaping. In other applications, railings and fences are practical or mandatory. For example, a raised deck will require railings to comply with building codes.

Standard deck railings and fences are typically constructed using a series of posts anchored to the ground or flooring structures. The posts are connected via generally rectangular planar sections that provide the containment function, such as preventing the passage of people or animals. In many fencing and railing systems, these sections are formed by a top and bottom vertical rails that are tied together by a plurality of vertical members sometimes referred to as balusters. In other arrangements, the top and bottom railings are tied together (or integral with) a solid sheet of material, such as mesh, glass, metal, wood, composites, etc.

There are advantages and disadvantages to both solid fencing/railing section and "open" sections that use balusters. For example, the solid sections can block wind and prevent the passage of very small items and can offer privacy. However, blocking the view of what is behind the fence or rail can sometimes be a disadvantage. An open section provides a view through the railing, with the resulting loss of privacy. Oftentimes, a user may want the privacy of a solid section during some conditions, and yet under other conditions may desire the outward-looking view provided by open sections. It would be advantageous, therefore, to have a fence or railing that selectably offers the advantages of both open and solid sections depending on current use conditions.

SUMMARY

To overcome limitations in the prior art described above, and to overcome other limitations that will become apparent upon reading and understanding the present specification, the present invention discloses methods and apparatus related to fencing/railing sections. In one embodiment, a railing section is capable of being adapted for varying conditions of use. The railing section includes first and second support rails. The first support rail has a longitudinal void. A plurality of movable fence members are perpendicularly disposed between the first and second support rails. A drive mechanism is disposed in the longitudinal void of the first support rail and coupled to the plurality of movable fence members. Operation of the drive mechanism causes simultaneous rotation of the movable fence members along longitudinal axes of the respective movable fence members through an angle of 360 degrees or more.

In more particular embodiments, the respective longitudinal axes of the first and second support rails are horizontally oriented, and the respective vertical axes of the plurality of movable fence members are vertically oriented. In one configuration, the first support rail is above the second support rail. In another more particular embodiment, the drive mechanism comprises a plurality of gears disposed along the longitudinal void of the first rail. The plurality of gears may include drive gears and idler gears. In such a configuration, each of the drive gears is fixably coupled to one of the movable fence members, and the idler gears are rotatably coupled to the first support rail and disposed between adjacent drive gears. In another configuration, the drive mechanism includes a plurality of rubber wheels disposed along the longitudinal void of the first support rail In other, more particular embodiments, the rail section may further include a slip mechanism coupled between the drive mechanism and movable fence members. The slip mechanism decouples the movable fence members from the drive mechanism when a force between the movable fence members and the drive mechanism satisfies a predetermined value. In other, more particular arrangements, the rail section may further include an electrically controllable actuator coupled to the drive mechanism that causes rotation of the movable fence members in response to an input signal. In such an arrangement, the rail section may also include a flexible rotational drive member coupled between the electrically controllable actuator and the drive mechanism. In one configuration, the flexible rotational drive mechanism includes a flex shaft. In another configuration, the railing section includes a structural support member that encloses the electrically controllable actuator. In another configuration, the electrically controllable actuator comprises an electric motor.

In another embodiment of the invention, a railing system that is capable of being adapted for varying conditions of use includes a plurality of railing sections. Each railing section includes first and second support rails, with the first support rail having a longitudinal void. A plurality of movable fence members are perpendicularly disposed between the first and second support rails, and a drive mechanism is disposed in the longitudinal void of the first support rail and coupled to the plurality of movable fence members. Operation of the drive mechanism causes simultaneous rotation of the movable fence members along longitudinal axes of the respective movable fence members through an angle of 360 degrees or more. The railing system also includes a plurality of mounting members connected to a mounting surface. The mounting members couple the first and second support rails of adjacent railing sections. The railing system also includes one or more coupling members disposed through one or more of the mounting members. The coupling members rotatably couple the drive mechanisms of two or more of the railing sections.

In more particular embodiments, the drive mechanisms of the plurality of railing sections each include a plurality of gears disposed along the longitudinal void of the first rail of the respective railing section. The plurality of gears may include drive gears and idler gears. In such an arrangement, each of the drive gears is fixably coupled to one of the movable fence members of the respective railing section, and the idler gears are rotatably coupled to the first support rails of the respective railing section and disposed between adjacent drive gears of the respective railing section.

In other, more particular embodiments, the railing system may further include an electrically controllable actuator coupled to the drive mechanism of at least one of the railing sections. The actuator causes rotation of the movable fence members in response to an input signal.

In another embodiment of the invention, a method of forming a railing section involves rotatably locating a plurality of movable fence members perpendicularly between first and second support rails. A drive mechanism is disposed in a longitudinal void of the first support rail, and the drive mechanism is coupled to the plurality of movable fence members so that operation of the drive mechanism causes simultaneous rotation of the movable fence members along longitudinal axes of the respective movable fence members through an angle 360 degrees or more.

In more particular embodiments, the method further involves coupling a shaft to the drive mechanism so that the flexible shaft activates the drive mechanism in response to a torsion applied to one end of the flexible shaft. The method may also involve coupling an electronically controllable actuator to the flexible shaft and/or coupling an electrically controllable actuator to the drive mechanism, so that the actuator causes rotation of the movable fence members in response to an input signal.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which are illustrated and described representative examples of systems, apparatuses, and methods in accordance with the invention.

BRIEF DESCRIPTION OF THE DRAWINGS

The invention is described in connection with the embodiments illustrated in the following diagrams.

FIG. 2A is a perspective view of a gear drive train according to an embodiment of the invention;

FIGS. 2B-E are top views of alternate drive train mechanisms according to embodiments of the invention;

DETAILED DESCRIPTION

In the following description of various exemplary embodiments, reference is made to the accompanying drawings that form a part hereof, and in which is shown by way of illustration various embodiments in which the invention may be practiced. It is to be understood that other embodiments may be utilized, as structural and operational changes may be made without departing from the scope of the present invention.

Generally, the present invention is directed to a containment structure that has containment sections that are selectable depending on use conditions. The term containment structure as used herein generally refers to a fencing or railing system. However, the present invention may be applicable to structures that are intended to contain humans or animals, such as enclosures (e.g., pens, garages), window/door, shutters, gates, verandas, gazebos, parapets, ship decks, hot tub and swimming pool surrounds, roof/overheads, horizontal or vertical supports, walls, roofs, etc. Similarly, the term containment section generally refers to the sections that tie together anchor/edge structures such as posts/walls.

The present invention is directed to methods and apparatus of offering adjustable containment sections that can support different use conditions. In one example, these use conditions may be an adjustment between a closed and open configuration. Generally, the closed configuration blocks some or all of the containment section, so that it appears as if the containment section was formed of a solid sheet. The open configuration has openings/voids so that light and matter might pass through. In some embodiments, transitioning between the open and closed configuration may involve rotating flat, oblong balusters around their longitudinal axis.

There may be other use conditions that are alternatives to or additional to the "open" and "closed" states described herein. For example the changing of the containment sections may involve changing the appearance of the sections. This could be accomplished, for example by forming balusters having differing appearances on differing sides. Therefore, such an arrangement may have multiple closed or open states, each corresponding to a different appearance caused by the orientation of different sides of the balusters shapes.

Figure 1:
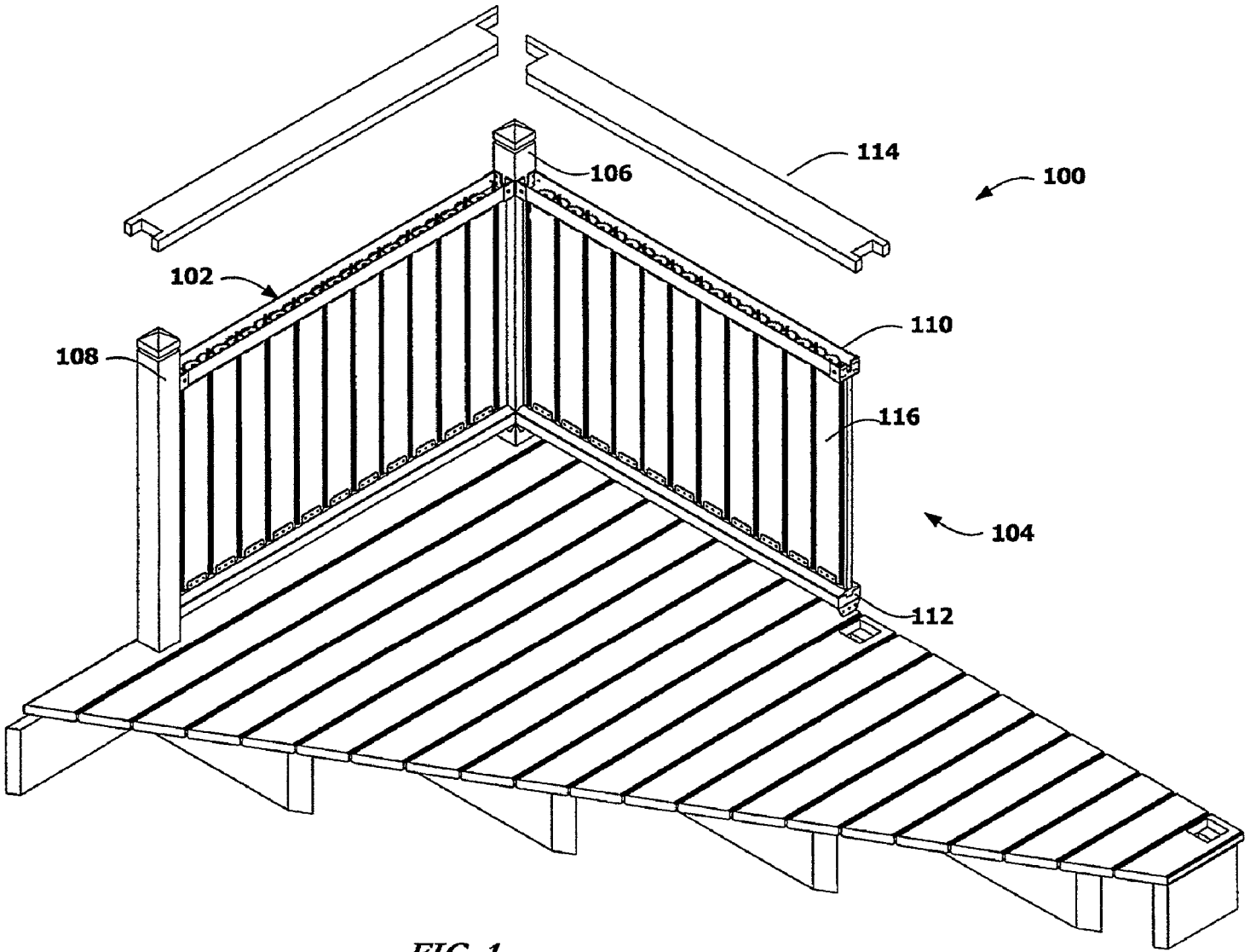
FIG. 1 is a perspective view of a containment structure assembly according to an embodiment of the invention.

In reference now to FIG. 1, a perspective view is shown of a containment structure 100 in a deck railing installation according to an embodiment of the invention. In the description that follows, the same reference number may be used denote equivalent components in different figures. As seen in FIG. 1, two rail sections 102, 104 are anchored to posts 106, 108, such as standard 4×4 wooden beams. The invention is not dependent on any particular type of post 106, 108. Posts will generally be chosen based on strength requirements, aesthetics, materials used in the project, etc. A containment structure may be formed using any number of posts 106, 108 and rail sections 102, 104 coupled together to form a continuous or semi-continuous structure. The rail sections 102, 104 and the rest of the structure 100 may be formed from any combination of materials, including glass, wood, metal, polymers, composites, bulletproof materials, etc.

For purposes of further discussion, the features of rail sections will be discussed with reference to section 104, as structure 100 may include a plurality of substantially identical sections as typified by section 104. The section 104 includes top and bottom rails 110, 112. Top rail 110 also includes a rail cap 114 that covers and protects mechanisms in the top railing 110. The section 104 also contains a plurality of rotatable balusters 116. In this example, the balusters 116 are flat, thin, rectangular members that are rotatable around their longitudinal axes, which are vertical in this arrangement. The balusters 116 may rotate in response to forces provided from driving mechanisms contained in the top rail 110. A more detailed view of the top rail 110 of a section 102 according to an embodiment of the invention shown in FIG. 2A.

Generally the top rail 110 may include a conduit 202, such as a U-channel or C-channel member, which provides the structural support for the rail 110. The channel member 202 may be formed, for example, from sheet metal, aluminum, plastics, composites, or any other appropriate material. The channel conduit 202 can enclose drive mechanisms 204 that cause the balusters 116 to rotate, as well as motors, wires, transmission members, or other control components of the decking system. In this example, the drive mechanism 204 includes a drive gear 206 coupled to each of the balusters 116, and idler gears 208 between each of the drive gears 206. The drive gears 206 and idler gears 208 form a drive train that allows the balusters 116 to be rotated in unison along each section 102.

Generally, one of the drive gears 206 or idler gears 208 will be coupled to a rotational drive (e.g., crank, motor) that causes the rotation of one or more of the balusters 116 in a section 102, thereby opening and closing the section 102. In the illustrated top rail 110, a gap 210 allows a drive mechanism to enter the conduit 202 and contact an end drive gear 206*a*, and thereby drive the gears 206, 208 in the section. The gap 210 and associated mechanisms can also be arranged to couple multiple sections 102 so that a single drive element can open and close multiple sections. In such a case, the end gear 206*a* could be configured to be driven by a rotational motor, by a coupling member (e.g., coupling gear assembly, drive/flex shaft) that is driven by the drive mechanism of an adjacent section 102, and/or to actuate a coupling member that drives adjacent sections 102.

The illustrated drive train 204 utilizes a single idler gear 208 between each drive gear 206. Those skilled in the art will appreciate that any number of intermediate idler gears 208 may be utilized, depending on the size of the gears 206, 208, size of the balusters 116, and other factors. Generally, an odd number of idler gears 208 will be used where it is desired to rotate all of the balusters 116 in the same direction; otherwise with an even number of idler gears 208 (or no idler gears 208) each baluster 116 will rotate in the opposite direction of the adjacent baluster 116.

Figure 2D:
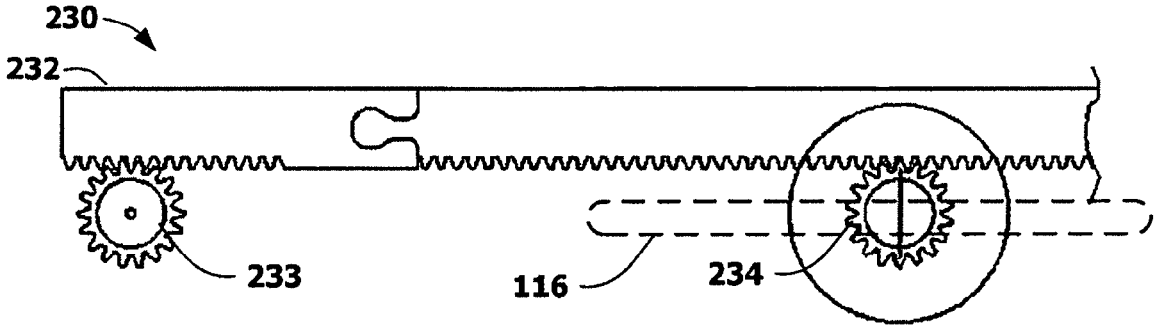
Figure 2E:
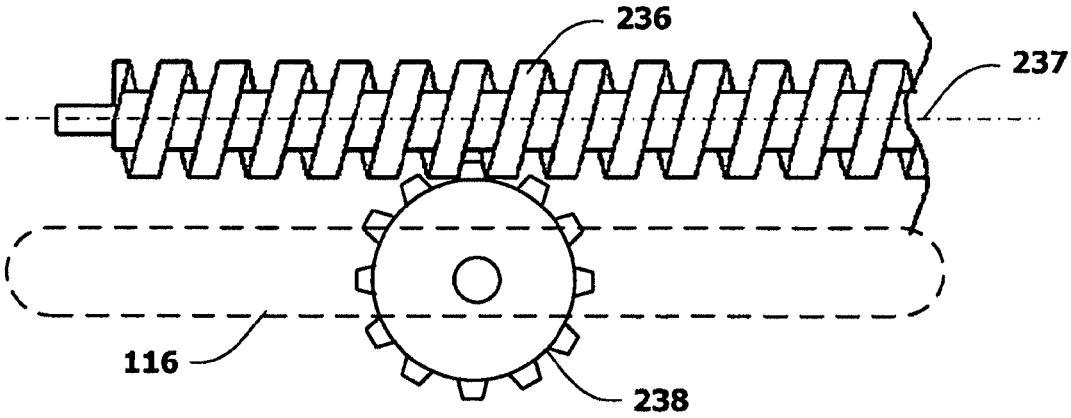

Although the drive train 204 in FIG. 2A utilizes gears to move the balusters 116, it will be appreciated that any manner of mechanical and electromechanical apparatus may perform this function, including wheels, belts, pulleys, cables, cranks, rack and pinion, worm gears, etc. For example, FIG. 2D shows a drive mechanism 230 according to an embodiment of the invention that uses a rack 232 and pinion gears 233, 234. One of the gears 233, 234 may be coupled to a drive mechanism and the other(s) to balusters 116. Alternatively, the rack 232 may be driven linearly (e.g., by a push-pull cable), and all of the pinion gears 233, 234 may be coupled to balusters 116. Although the illustrated drive mechanism 230 may allow for baluster rotation greater than 360 degrees, whether this is achievable depends on the space available in any enclosing structures. In FIG. 2E, a worm gear 236 may be rotationally driven about its longitudinal axis 236 and cause rotation of drive gear 238 coupled to baluster 116. The arrangement in FIG. 2E is capable of driving baluster 116 greater than 360 degrees, and can generally be continuously adjusted without requiring reversal of the worm gear 236.

Figure 5A:
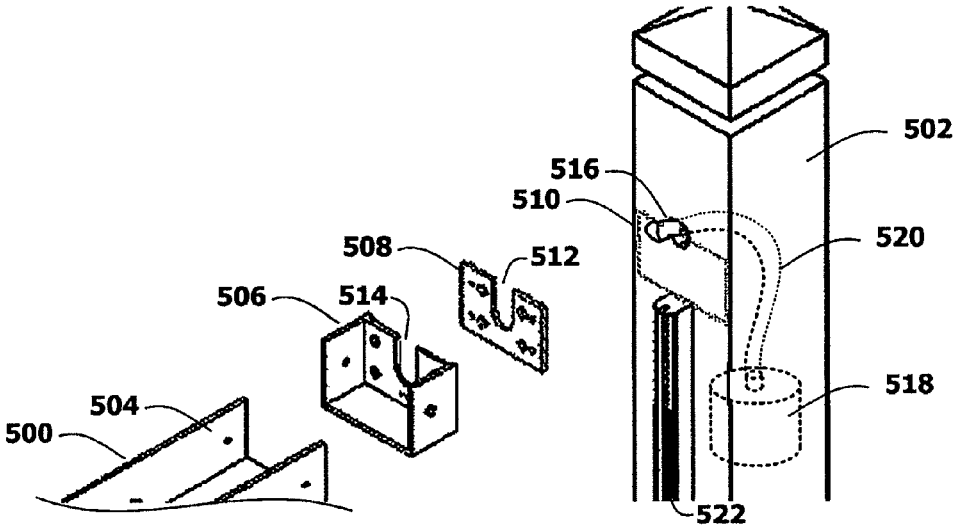
FIG. 5A is a perspective view of a rail to post attachment according to an embodiment of the invention.
Figure 5B:
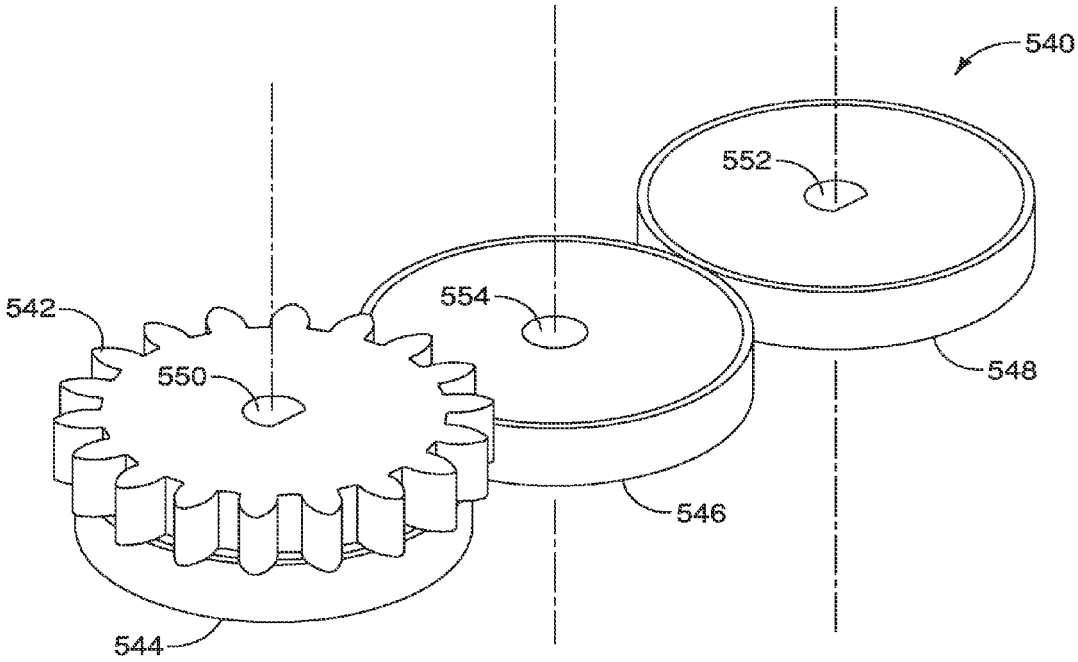
FIG. 5B is a perspective view of a wheel-to-wheel baluster drive mechanism according to an embodiment of the invention.

In reference now to FIG. 5B, an alternate configuration of a drive train assembly 540 according to an embodiment of the invention is illustrated. This drive train assembly 540 utilizes wheel-to-wheel contact to rotate each of the balusters. A wheel-to-wheel contact arrangement allows individual balusters to slip when the drive force exceeds a predetermined value, thereby allowing for the prevention of injuries or product damage due to pinching.

Generally, a drive gear 542 is located on the one end of the drive train 542 and is coupled with a drive wheel 544. This drive wheel 544 is in contact with idler wheel 546, which is in contact with drive wheel 548. The drive train 540 is made of as many drive and idler wheels as there are individually driven balusters. Note that the drive wheels 544, 548 include respective oblong holes 550, 552 to prevent slipping of the wheels on drive shaft, whereas the idler wheel 546 includes a round hole 554 for free rotation on its shaft. The drive gear 542 may be included at both ends of the drive train 540, and the drive gears may be coupled to any number of idler and drive wheels.

Figure 6A:
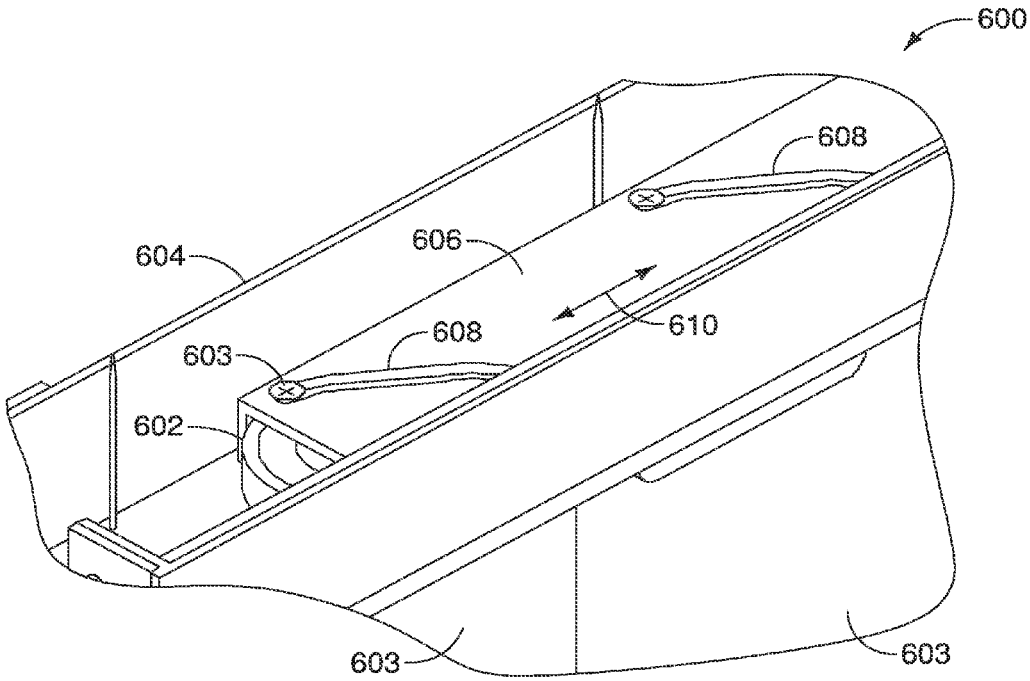
FIG. 6A is a perspective view of a slotted baluster drive mechanism according to an embodiment of the invention.

In reference now to FIG. 6A, an alternate configuration of a drive train assembly 600 according to an embodiment of the invention is illustrated in a perspective view. In this drive train 600, a drive wheel 602 is coupled to each baluster 603. The drive wheel 602 includes an offset pin 603 with a bearing/bushing protruding upward. A slide member 606 is disposed in the rail conduit 604 and coupled to each of the drive wheel pins 603 by a series of slots 608. Movement of the slide member 606 in the longitudinal direction, as indicated by arrow 610, causes the drive wheel 602 and respective baluster 603 to rotate. This drive train assembly allows the balusters 603 to be driven by any combination of linear motion (e.g., applied to the slide member 606) and rotational motion (e.g., applied to one or more drive wheels 602).

Figure 6B:
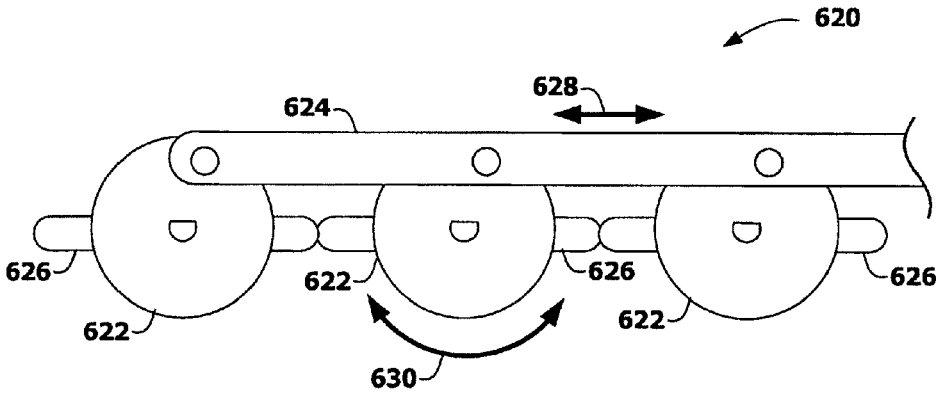
FIG. 6B is a top view of a crank drive train of a rail section according to an embodiment of the invention.

In reference now to FIG. 6B, a top view is shown of another drive train assembly 620 that may be driven by a combination of linear and rotational drives according to an embodiment of the invention. In this example, a plurality of drive wheels 622 are rotatably coupled to a crank member 624. The drive wheels 622 are each coupled to a baluster 626. Linear motion of the crank member 624, as indicated by arrow 628, causes rotation of the drive wheels 622 as indicated by arrow 630. This drive train 620 may also be driven by linear or rotational driving mechanisms. It will be appreciated that the crank member 624 will also move up and down relative to the illustrated motion 628, and any linear drive mechanisms (e.g., push-pull cables, pistons) will need to take this additional component of motion into account.

In any of the drive train embodiments described herein, the drive trains may be located in the lower rail section 112 (see FIG. 1), or may be distributed between both upper and lower rail sections 110, 112. Also in the examples described above, each baluster 116 may be capable of rotating 360 degrees or more around a vertical axis, such as axis 212 shown on the middle baluster 116 of FIG. 2A. The balusters 116 generally rotate together in the same direction, however other arrangements may cause some balusters to rotate differently. For example, FIGS. 2B and 2C show alternative coupling arrangements according to embodiments of the invention that may cause adjacent balusters to rotate oppositely.

In FIG. 2B, a plurality of drive pulleys 214 are coupled by a flexible member 216 (e.g., belts, chains, rubber o-rings, etc) that is crossed between each pulley 214. As indicated by arrows 224, 220 adjacent pulleys 214 move in opposite directions when force is applied on member 216 in the direction of arrow 222. Other arrangements such as shown in FIG. 2B could be implemented using a plurality of flexible members 216, such by using one member 216 for each pair of pulleys. In FIG. 2C, drive gears 224 directly mesh with each other, resulting in opposite rotation of adjacent balusters as indicated by arrows 226, 228. It will be appreciated that any variations of the arrangements shown in FIGS. 2A-C will allow balusters to rotate through an angle greater than 360 degrees in the same or opposite directions.

Figure 3:
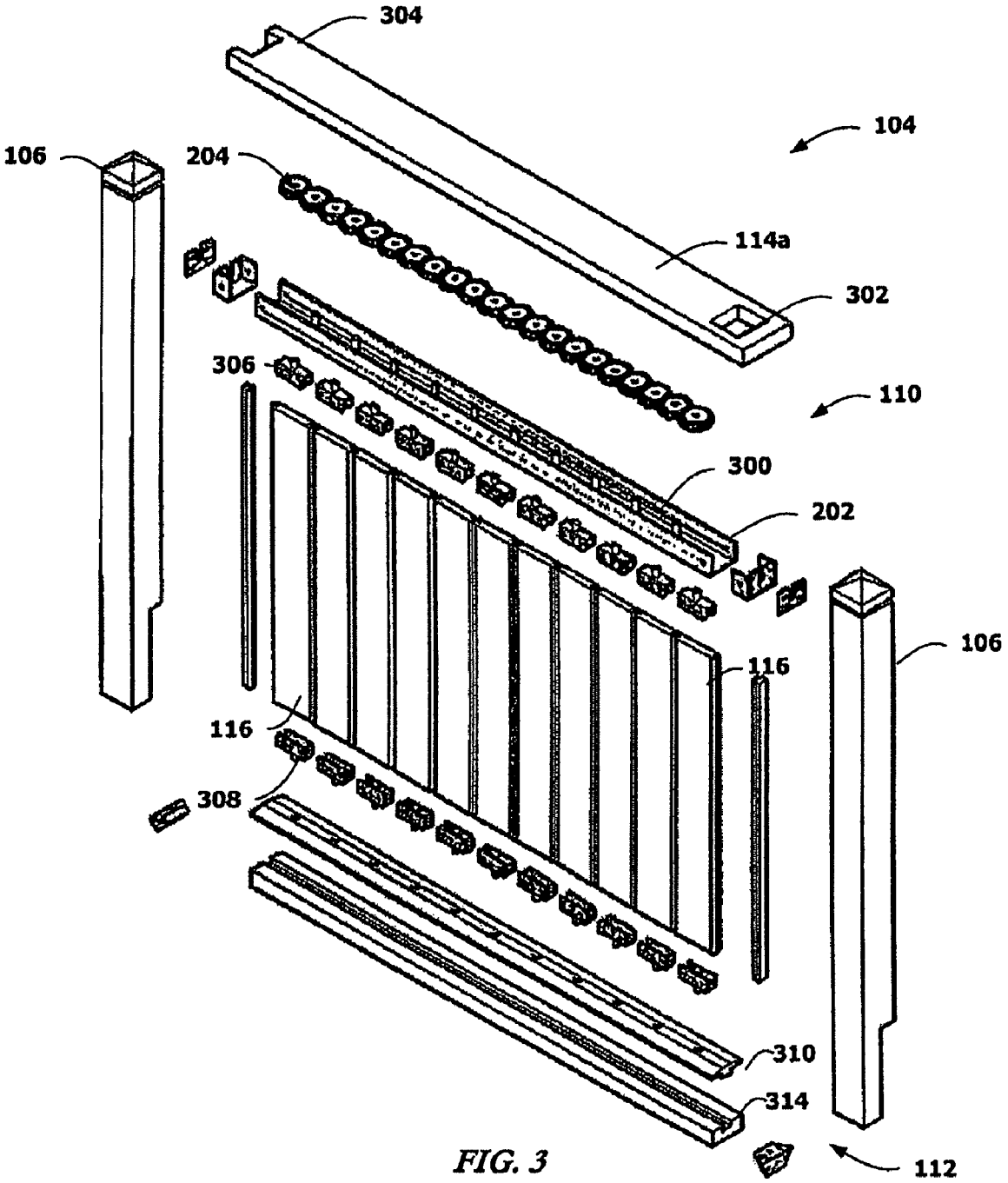
FIG. 3 is an exploded perspective view of a rail section according to an embodiment of the invention.

In reference now to FIG. 3, an exploded view of rail section 104 shows additional design details according to an embodiment of the invention. Generally, the rail section 104 may incorporate end posts 106 into the assembly, or the rail section 104 may be assembled separately and fastened to end posts 106 during installation. The hollow channel member 202 may include posts 300 or other features to facilitate fastening of the gear section 204 (or other drive mechanism). The rail cap 114*a* in this illustration differs from the rail cap 114 in FIG. 1, in that the cap 114*a* includes a void 302 that is capable of fitting over a post 106. The rail cap 114*a* also includes a notch 304 that interfaces with a post 106, similar to the rail cap 114 shown in FIG. 1. It will be appreciated that other railing cap arrangements with no notches or voids are within the scope of present embodiments of the invention.

The balusters 116 are fastened at top and bottom edges to respective top and bottom pivot members 306, 308. The top pivot members 306 interface with the drive assembly 204 so that, in response to a driving element (e.g., motor), the drive assembly 204 causes rotation of the balusters 116. The bottom pivot members 308 are arranged to pivot freely in a pivot channel 310 of the lower railing 112. In some arrangements, the pivot channel 310 may be directly attached to a lower support structure (e.g., horizontal deck surface) thereby precluding the need for the lower railing 112.

The pivot channel 310 may be formed of a material that allows the desired level of friction (or lack thereof) in the balusters 116, or bearing elements 312 may be placed between the balusters 116 and pivot strip 310. The bearing elements 312 may include sleeves, bushing, ball bearings, inserts, etc. The pivot channel 310 is coupled to a lower support member 314 that provide structural support and enhances the appearance of the lower railing 112.

Figure 4:
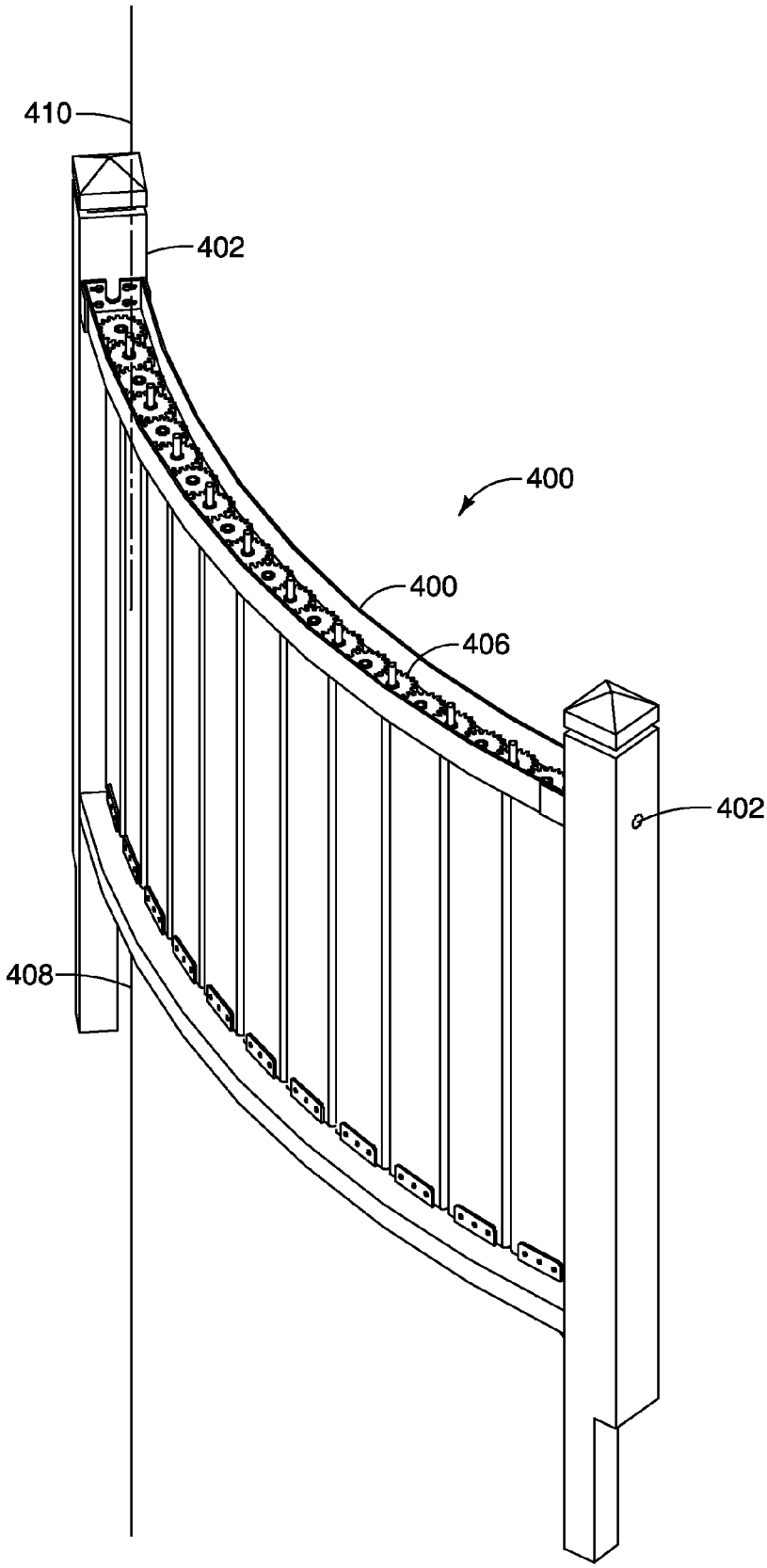
FIG. 4 is a perspective view of a curved rail section according to an embodiment of the invention.

One advantage to using a drive train assembly 204 with multiple gears/wheels is that the assembly 204 may be adapted to different railing shapes. This is shown in FIG. 4, which shows a curved railing section 400 according to an embodiment of the invention. A curved upper support channel 404 is disposed between two posts 402. A plurality of gears 406 or other drive elements are arranged inside the channel 404. The gears 406 are coupled to balusters 408 and capable of rotating the balusters 408 along a vertical axis 410. Other details of the curved rail section 400 may be substantially similar to the straight sections as described elsewhere herein. It will be appreciated that the curved support channel 404 may assume any shape that will allow the elements of the drive train 406 to interact. Further, a containment structure may use any combination of curved sections 400 and straight sections (e.g., section 104 in FIG. 1) that are coupled to operate together.

In reference now to FIG. 5A, a perspective view shows further details of how a horizontal conduit channel 500 is coupled to a vertical support post 502. The channel 500 contains a space 504 capable of containing drive train components and other apparatus used to change the orientation of rail balusters. An end cap 506 is fastened to the channel 500 to provide structural rigidity and to provide a mounting attachment between the channel 500 and post 502. The end cap 506 and sealing member 522 may be made adjustable to accommodate several varying post-to-post distances, thereby allowing railing sections to be made in a discrete width sizes. A mounting plate 508 is fastened to the vertical support post 502 at a variable predetermined height over posthole 516 to attach the end cap 506 to mounting area 510. A varying width mounting plate 508 may also be utilized between the end cap 506 and mounting area 510 of the post 502 to account for variations in rail section sizes and post placement.

Note that the mounting plate 508 and end cap 506 have respective voids 512, 514 through which drive apparatus may be located. These voids 512, 514 are aligned with a hole 516 in the post 502. A drive apparatus such as a motor 518 may be located within the conduit 500, within one or more posts 502, or may be located entirely remotely from the railing system. In the either case, a rotational drive element such as a flex shaft 520 might be coupled between internal or external drive apparatus and the drive train in the railings (e.g., gears 204 in FIG. 2). In other arrangements, the flex shaft 520 may also couple adjacent rail sections so that two or more sections are driven together. A rotating motor 518 and rotational coupling member 520 is only one possible source of actuation force. For example, the actuation force may be linear, such as provided by slides, push-pull cables, pistons. Similarly, mechanisms that couple adjacent rail sections may also be generally linear in motion. For example, drive sections may utilize crank shafts or rack and pinion drive trains, and adjacent drive trains can be coupled using rigid members such as rods.

The post 502 also has a sealing member 522 attached to it. This sealing member is substantially aligned with the edge of an end baluster in a railing assembly. The portion of the sealing member 522 that contacts the baluster may be a brush, rubber/foam seal, etc. The use of softer materials may be preferable to prevent pinching hazards. The sealing member 522 may be configured to provide a positive physical engagement so that the balusters lock into a closed position. The sealing member 522 may also assist in preventing the passage of light and matter when the railing system is in the closed position. Similarly, the balusters themselves may have edge features that assist in sealing off the closed rail section and providing positive engagement for the closed baluster members. These sealing features may also include a substantially compliant portion that reduces risk of pinching.

Figure 5C:
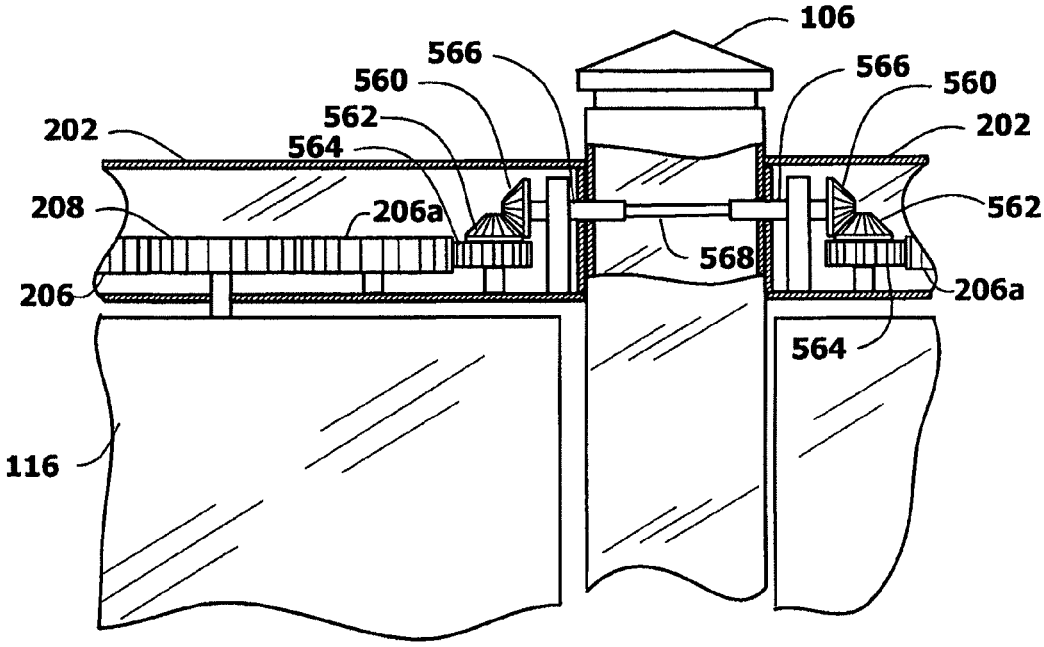
FIG. 5C is a side view of a miter gear rail section drive mechanism according to an embodiment of the invention.

As described above in relation to FIG. 5A, coupling apparatus may be deployed through posts in order to couple the drive trains of adjacent rail sections. An example arrangement of coupled drive trains for adjacent rail sections according to an embodiment of the invention is shown in FIG. 5C. Generally, channels 202 are connected to post 106. The post 106 and conduits 202 include holes for coupling drive trains contained within the conduits 202. End idler gears 206*a* are driven by miter gears 560, 562 which translate the horizontal rotation of drive shafts 566 into vertical rotation of the idler gears 206, 206*a*, and baluster drive gears 208. Lower miter gears 562 are fixably coupled to a small drive gear 564 that meshes with idler gears 206*a*. The use of miter gears 560, 562 to change axis of drive rotation is presented for purposes of illustrations and not of limitation. Other mechanisms known in the art can also achieve this change in rotational axes, including helical gears, spur gears, worm gears, universal joints, flexible joints, gearboxes, transmissions, etc.

Figure 5D:
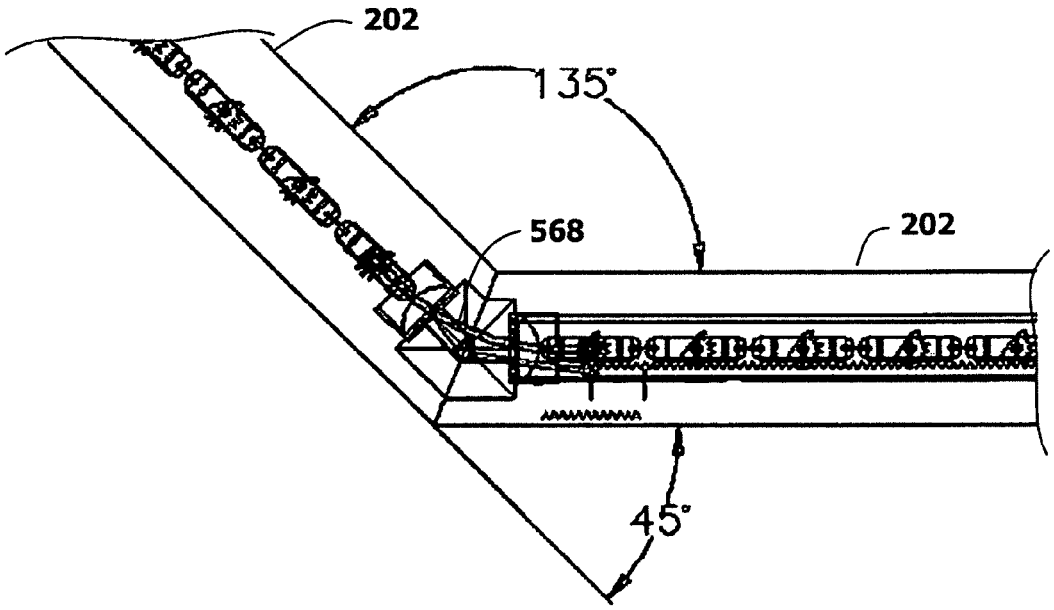
FIG. 5D is a top view of a drive mechanisms of adjacent rail sections being coupled by a flexible member according to an embodiment of the invention.

Although the drive shafts 566 of adjacent sections may be rigidly coupled, in many installations, it may be beneficial to couple the shafts 566 using a flexible member, such as flex shaft 568. A flex shaft 568 can reduce stresses on the gearing components caused by misalignment of sections. Further, a flexible shaft 568 can provide driving rotations between adjacent angled sections, as seen in FIG. 5D. In this figure, the conduits 202 of two adjacent sections are oriented at a 135-degree angle, and the flex shaft 568 is used to couple the drive trains of the sections.

Figure 5E:
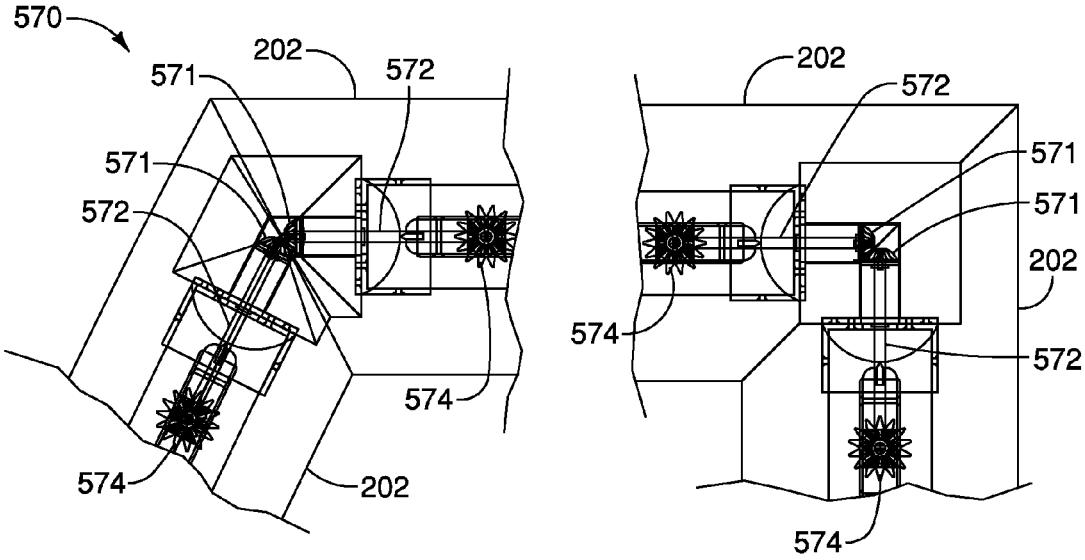
FIG. 5E is a top view of a drive mechanisms of adjacent rail sections being coupled by a angled gears according to an embodiment of the invention.

Use of a flexible member 568 may allow the angle between adjacent sections to be as small as 90 degrees, or smaller. However, the stresses on flexible members 568 will increase as the bend angle becomes smaller. Therefore, a system according to embodiments of the invention may use an angled gear coupling 570 as shown in FIG. 5E. Generally, angled gears 571 (e.g., miter gears, helical gears, spur gears) are meshed at the intersection of adjoining conduit members 202. The gears 571 are coupled to shafts 572 that couple respective railing drive mechanisms 574. At least one of the drive mechanisms 574 in a system are coupled to mechanical transducers (e.g., motors). It will be appreciated that each of the respective drive systems 574 could be independently driven by a motor, thus the angled coupling (or other couplings described herein) may be optional.

In the previous examples, the balusters are shown as elongated, thin plates, such as balusters 116 shown in FIG. 1. Such balusters 116, when rotated in the closed position can substantially block light and matter from passing through rail sections 104, 102. When rotated in the open position, the thin cross section of the baluster 116 is parallel with the plane of the rail section 104, 102, and therefore a substantial amount of light (as well as small objects or wind) can pass through. Because the balusters 116 in some embodiments can be rotated more than 360 degrees, there are two closed positions, one for each face of the baluster 116. In some arrangements, therefore, the appearance of the rail sections 104, 106 can be changed depending on which closed configuration the balusters 116 are currently deployed. For example, one face of the balusters 116 might have a wood grain finish, and the other face may have a nature scene painted across all of the balusters 116. Thus, the rail sections 104, 106 may have two distinct appearances in the closed position that are selectable by the user.

Figure 7A:
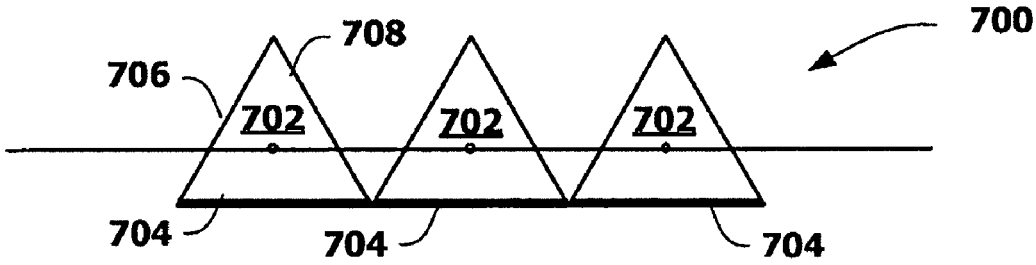
FIGS. 7A-D are top views of an alternate baluster cross section arrangement according to an embodiment of the invention
Figure 7B:
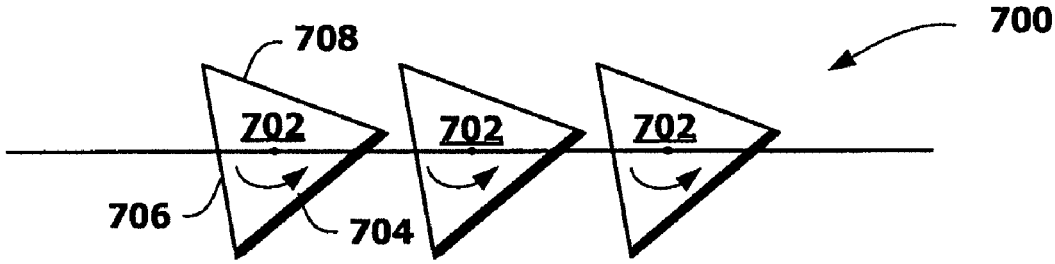
Figure 7C:
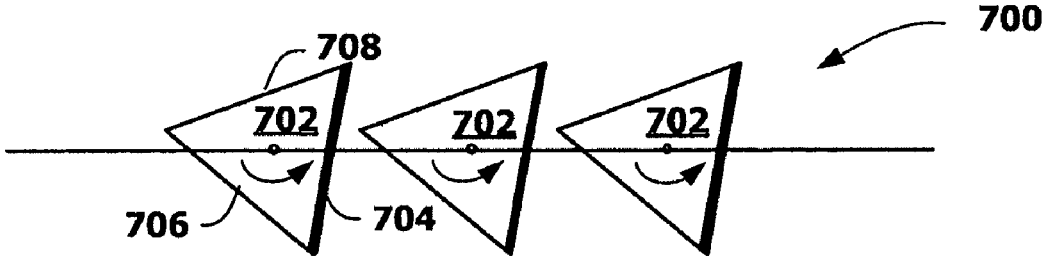
Figure 7D:
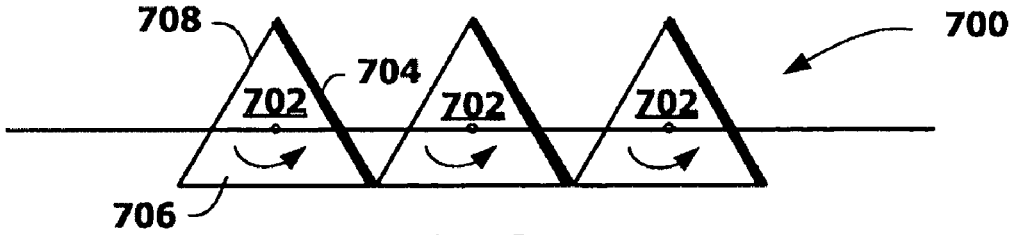

In other arrangements, rail sections according to embodiments of the invention may have more than two appearances in the closed position, as is illustrated in FIGS. 7A-D. FIG. 7A is a top view of a deck section 700 that includes a plurality of balusters 702 having a triangular cross section. In the configuration of 7A, first sides 704 of the balusters 702 are facing one plane of the section 700. This plane might correspond to a view of the section from a person located on a deck, for example. The sides 704 are highlighted with bold lines to illustrate rotation of the balusters 702 in the direction indicated by the curved arrows of FIGS. 7B-D. In FIG. 7D, the balusters 702 are rotated in a second closed configuration, and side 706 now faces the plane where side 704 was formerly visible in FIG. 7A. It will be appreciated that the section may assume a third closed configuration (not shown), where side 708 faces the viewing plane.

Figure 8A:
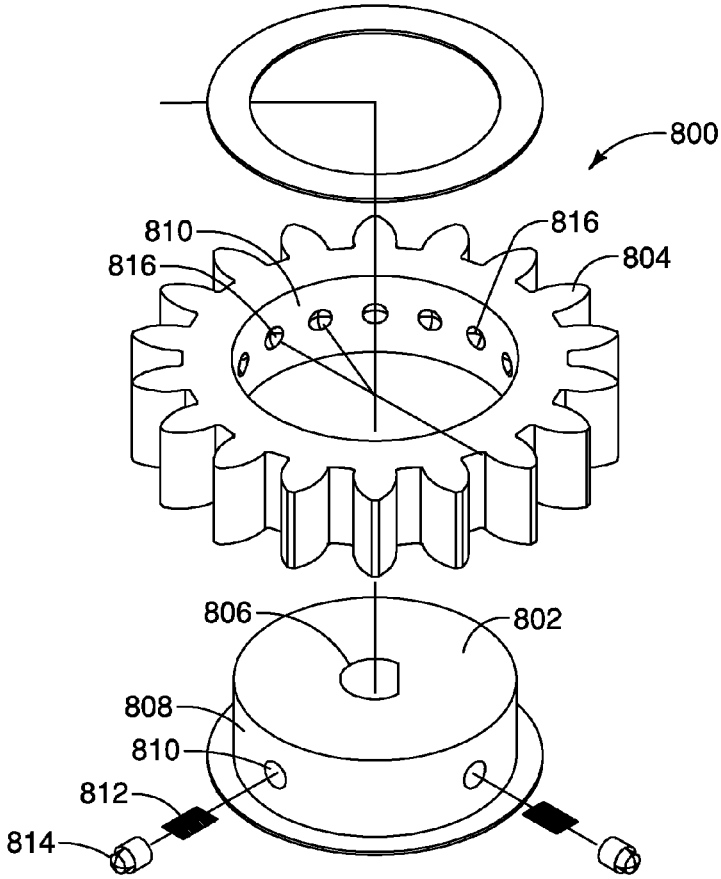
FIG. 8A is a perspective view of a slip drive gear according to an embodiment of the invention.

As described in relation to previous drawings, it may be desirable or necessary to incorporate some type of slippage mechanisms in the baluster drives. A slippage mechanism can prevent injury to people and/or damage to property due to objects being pinched between closing balusters. It may be possible to have the main drive gear (e.g., drive gear attached to an edge baluster) slip, and have all other balusters substantially fixed to their drive gears. In most configurations, this would place a limit on the closing forces at all of the balusters. In other cases, it may be preferable or desirable to allow each baluster to slip individually. For example, the end user may want to purposely adjust some balusters out of parallel for a certain effect. Typically, though, it will be desirable to ensure the balusters remain substantially parallel, or at least be easily returned to a parallel configuration after slippage has occurred. In reference now to FIG. 8, an example slip mechanism 800 is illustrated that can provide slippage of individual balusters or of a whole drive train according to embodiments of the invention.

Generally, the slip mechanism 800 includes a shaft-coupled wheel 802 and an outer drive member 804 that are rotatably coupled. The shaft-coupled wheel 802 is fixably connected to a drive shaft via oblong hole 806. The illustrated outer drive member 804 includes gear teeth, although other drive member 804 may be adapted for pulleys, toothed belts, chains, rubber wheels, one-way bearing, and the like.

The outer surface 808 of the shaft-coupled wheel 802 slidably interfaces with the inner surface 810 of the outer drive member 804. The outer surface 808 of the shaft-coupled wheel 802 also includes one or more radial holes 810 that are each adapted to receive a spring 812 and latch pin 814. When the slip mechanism 800 is assembled, the one or more latch pins 814 are forced into detents 816 on the inner surface 810 of the outer drive member 804. When a sufficiently large moment is applied between the shaft-coupled wheel 802 and the outer drive member 804, the latch pins 814 will slip from the detents 816. This will provide the requisite slippage, yet allows the end user to easily relocate the driven member after slippage has occurred. It will be apparent that alternate variations and uses of the illustrated slip mechanism are possible. For example, the location of the detents 816 and latch pins 814 could be reversed relative to the inner and outer members 802, 804.

Figure 8B:
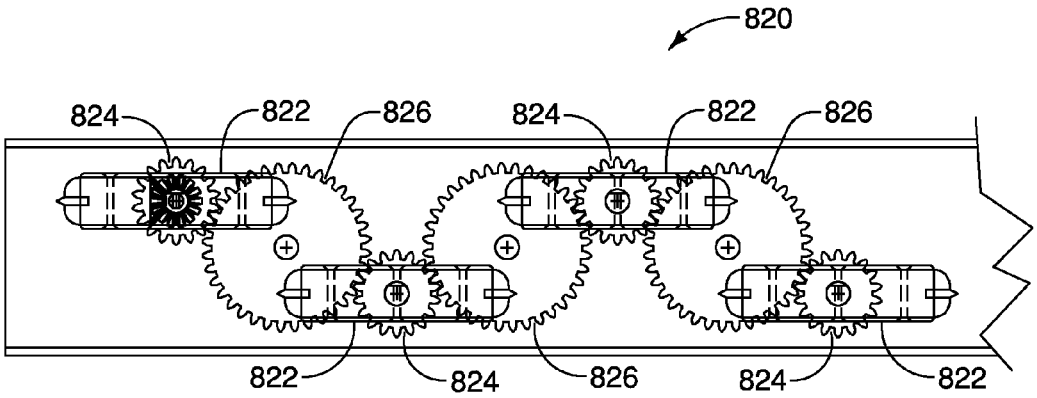
FIG. 8B is a top view of an alternate baluster arrangement according to an embodiment of the invention.

The baluster arrangement in some of the previously illustrated embodiments had the rotational axes of the balusters substantially inline along the rail sections. However, a top view of an alternate arrangement of balusters according to an embodiment of the invention is shown in FIG. 8B. In this figure, the rail section 820 has a plurality of planar balusters 822 that are each offset from the adjacent baluster 822. This arrangement, sometimes referred to as "shadow box" style, substantially reduces the risk of pinching hazards compared to arrangements where adjacent balusters for a seal. Note that the gearing may require different sizes of respective drive and idle gears 824, 826 (or other drive train mechanisms).

Figure 9A:
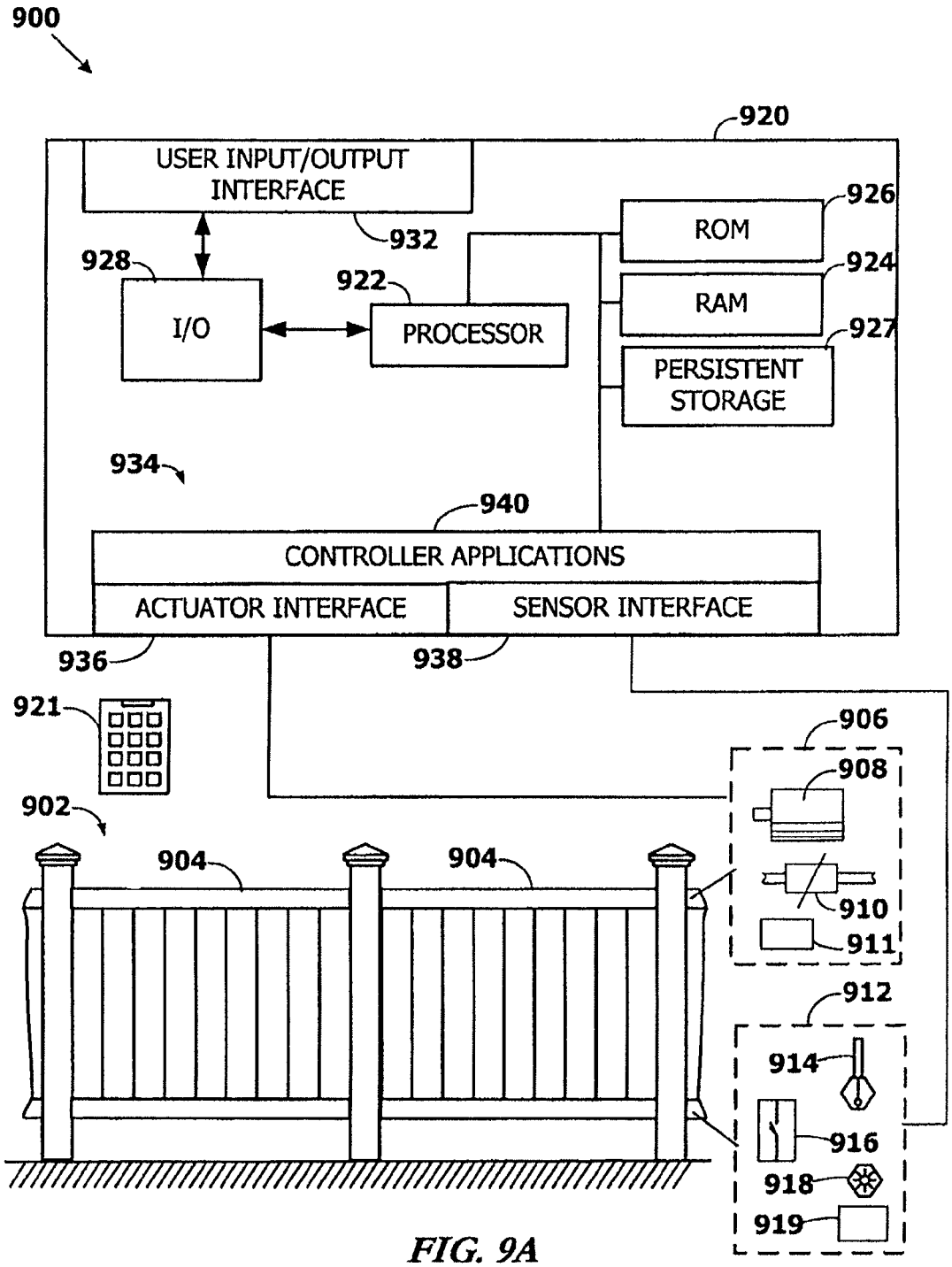
FIG. 9A is a block diagram of a system according to embodiments of the invention.

It will be appreciated that railing sections described herein can be equipped with any manner of automatic or manual drive mechanism, including manual cranks, wheels, sliders, motors, etc. In one arrangement, a manual hand crank may be used that has a locking or notched locking system so the balusters won't move in response to strong winds. One particularly useful arrangement is to use electronically controllable components that can be controlled by computing arrangements. Such an automated system according to an embodiment of the invention is shown in FIG. 9A. The system 900 includes a railing structure 902 with rail sections 904 having mechanically adjustable fence/baluster members as described hereinabove.

The adjustable sections 904 may be controlled by one or more electronically controllable actuators 906. These actuators 906 may include motors 908, valves 910, or any other actuating device, as represented by generic actuating device 911. The motors 908 may include one or more electrical motors 908 that are driven by any combination of AC or DC power. The motor(s) 908 may be controlled by switching power on and off, and may also accept digital or analog drive signals (e.g., step motor). Other sources of motive power besides electricity may be used to adjust the rail sections 904, such as hydraulic or pneumatic power. Such forms of power may be controlled by valves 910 and similar devices. The actuators 906 may be arranged to move sections 904 independently (e.g., one actuator per section 904), or even move balusters with the sections 904 independently (e.g., multiple actuators per section 904). In other arrangements, each actuator 906 may be coupled control as many sections 904 as possible, The number of sections that may practically be simultaneously driven may vary based on such factors as forces needed to move balusters, frictional losses in drive trains, effects of weather/temperature, etc.

Besides causing the movement of the railing structures 904, electronic apparatus can also obtain the input of sensors 912 in order to provide more sophisticated control options. Such sensors 912 may include, for example, temperature sensors 914, limit switches 916, light sensors 918 (e.g., photovoltaic cells), or any other sensor, as represented by generic sensor 919. These sensors 912 may be coupled to a component of the railing 902 itself, or located elsewhere. An example of a rail-mounted sensor is where the limit switch 916 could be used to prevent actuator operation during certain use or service conditions (e.g., cover removed, balusters located at user-defined limit, etc.). In another example, sensors 912 may be rail mounted or externally mounted, such as those that can detect certain weather conditions (e.g., sunlight, wind, precipitation) so that the rail sections 904 can be automatically operated based on a user-defined preference related to weather conditions. The sensors 912 may be combined with other devices. For example, a porch light or control switch for the light could be used as a sensor for purposes of controlling the rail sections 904. In such a case, the user may wish for the rail sections 904 to automatically close for privacy when the user is out on the porch at night and has turned the light on.

A computing arrangement 920 may be configured to control various operational aspects of the system 900. The computing arrangement 920 may include custom or general-purpose electronic components. For example, some or all of the functionality of the computing arrangement 920 described below may be incorporated into a wired or wireless remote control 921. The computing arrangement 920 includes a central processor (CPU) 922 that may be coupled to random access memory (RAM) 924, read-only memory (ROM) 926, and/or persistent storage 927. The ROM 926 may include various types of storage media, such as programmable ROM (PROM), erasable PROM (EPROM), etc. The processor 922 may communicate with other internal and external components through input/output (I/O) circuitry 928. The processor 922 carries out a variety of functions as is known in the art, as dictated by software and/or firmware instructions.

The persistent storage 927 may include one or more data storage devices, including hard and floppy disk drives, optical drives, flash memory, and other hardware capable of reading and/or storing information. In one embodiment, software for carrying out the operations in accordance with the present invention may be stored and distributed on a CD-ROM, diskette or other form of media capable of portably storing information. These storage media may be inserted into, and read by, devices such as a CD-ROM drive, disk drive, etc. The software may also be transmitted to computing arrangement 920 via data signals, such as being downloaded electronically via a network, such as the Internet. The computing arrangement 920 may be coupled to a user input/output interface 932 for user interaction. The user input/output interface 932 may include apparatus such as a mouse, keyboard, microphone, touch pad, touch screen, voice-recognition system, monitor, LED display, LCD display, etc.

The computing arrangement 920 includes processor executable instructions 934 for carrying out tasks of the computing arrangement 920. These instructions include actuator and sensor interfaces 936, 938 for communicating with respective actuator devices 906 and sensor devices 912. The actuator and sensor interfaces 936, 938 may include any combination of hardware electronics, basic input-output interfaces, software drivers, operating system components, and application level utilities. The actuator interface 936 generally controls the stopping and starting of actuators 906, and may control other aspects such as acceleration, operation speed, monitoring of on-device sensors (e.g., temperature and force transducers). The sensor interface 938 generally receives electronic signals indicative of physical phenomena detected by the sensors 912. The sensor interface 938 may include signal conditioning circuitry, analog-to-digital converters, and memory registers used to store sensed values.

Both the actuator and sensor interfaces 936, 938 may have their own application-level interfaces that allow a user to control and read data related to devices 906, 912. These interfaces 936, 938 may include user interfaces that allow people to interact with the devices 906, 912 via the user I/O interface 932 or similar interface apparatus. In a more useful arrangement, the interfaces 936, 938 may have application program interfaces (API) that allow another program, such as controller applications 940, to control these and other devices at the same time. A unified controller application 940 may use the device interfaces 936 directly through a custom API, or through other generic media and control interfaces. For example, the applications 940 and interfaces 936, 938 may implement home automation and control standards such as X10, Jini, Universal Plug and Play, and other home automation and ubiquitous computing standards known in the art. These standards allow the fencing system 900 to be integrated into larger-scale home or business automation network. For example, general purposes devices, such as the remote control 921, may be programmable to interface with the system 900 using these standards.

Figure 9B:
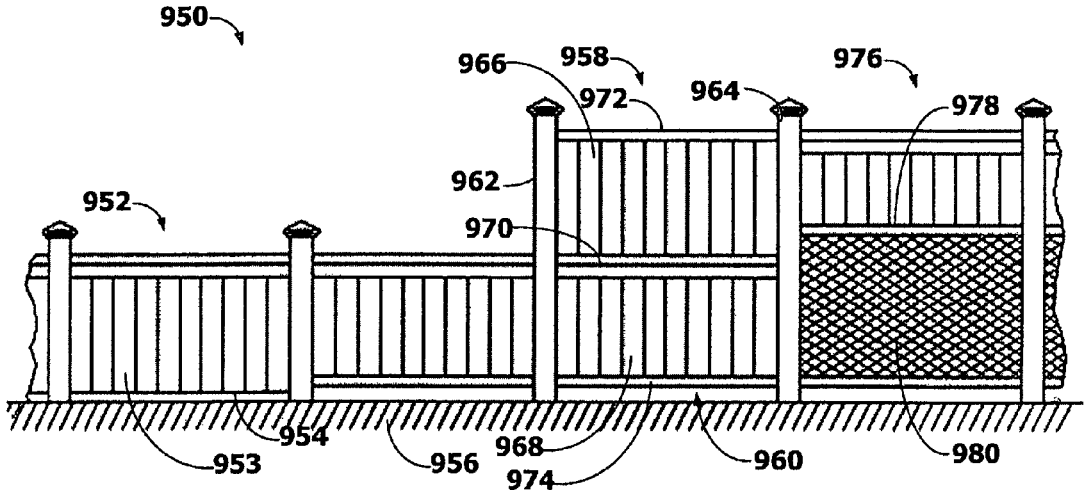
FIGS. 9B and 9C are side views of alternate arrangements of railing systems according to embodiments of the invention.

In reference now to FIG. 9B, a side view shows variations of a railing system 950 according to embodiments of the invention. The railing system 950 includes a rail section 952 with a plurality of rotatably driven balusters 953 that are held at the lower end by a pivot channel 954 that is coupled directly to the structural base 956 of the system (e.g., horizontal deck surface, ground, etc.) This railing section 952, therefore, does not require a lower horizontal railing.

Railing section 958 is located vertically above section 960, and, at least in the illustrated arrangement, share the same support posts 962, 964. In this arrangement, the balusters 966, 968 of the respective sections 958, 960 may be driven by the same drive mechanism. For example, a common drive mechanism may be located in horizontal section 970 that is tied to balusters 966 on the topside and tied to balusters 968 on the bottom side. In another configuration, single ones of the upper balusters 966 may directly tied to selected one of the lower balusters 968, and a single drive mechanism may be incorporated on either a top rail 972 or a bottom rail 974.

Finally, section 976 illustrates how a lower railing portion 978 (either a rail or pivot channel) may be coupled to something besides a structural base. In this arrangement, a lattice 980 is located directly below the lower member 978. The lattice 980 may be made integral to the deck section 976, or used to cover a space below a raised deck, for example.

Figure 9C:
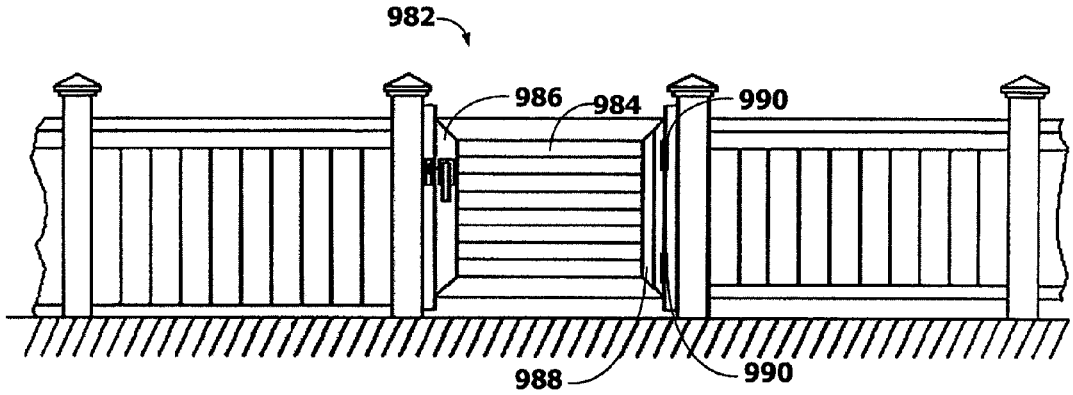

In reference now to FIG. 9C, a side view of a gate 982 is shown that incorporates adjustable balusters 984 according to an embodiment of the invention. The balusters 984 in this example are horizontally disposed and may be overlapping, and could be driven by mechanisms in one (or both) of side rails 986, 988. Typically, the actuating mechanism (e.g., motor, gears) would be enclosed in the gate 982 and attached via flexible power carriers (e.g., wires, pneumatic hoses). In this way, no mechanical drive members (e.g., shafts, gears) would have to be coupled to the gate 982, which could then rotate freely around hinges 990.

Figure 10:
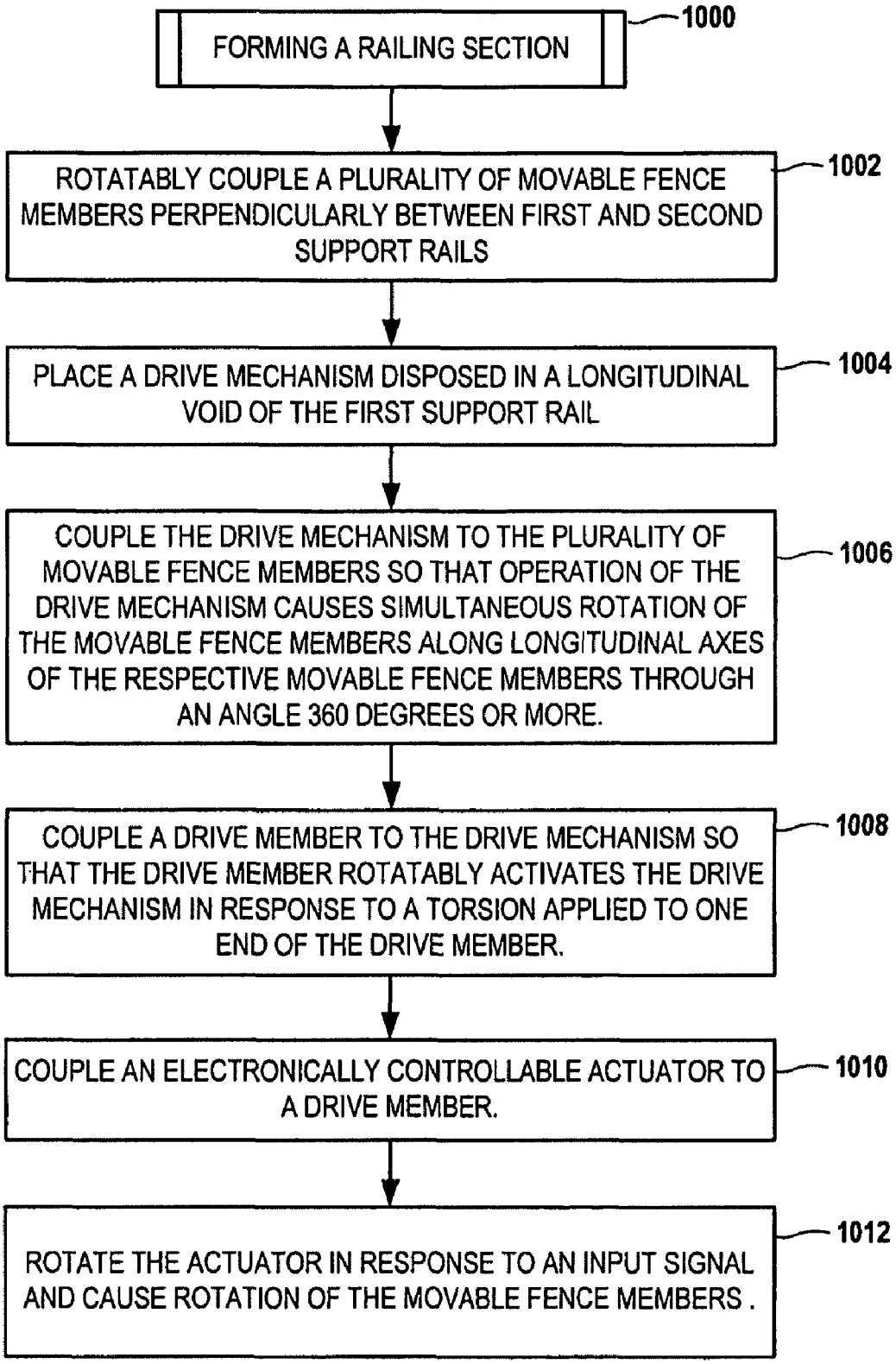
FIG. 10 is a flow diagram illustrating a method according to an embodiment of the invention.

In reference now to FIG. 10, a flowchart 1000 illustrates a method for forming a railing section according to an embodiment of the invention. A plurality of movable fence members are rotatably coupled 1002 perpendicularly between first and second support rails. A drive mechanism is disposed 1004 in a longitudinal void of the first support rail. The drive mechanism is coupled 1006 to the plurality of movable fence members so that operation of the drive mechanism causes simultaneous rotation of the movable fence members along longitudinal axes of the respective movable fence members through an angle 360 degrees or more. A drive member may be coupled 1008 to the drive mechanism so that the drive member rotatably activates the drive mechanism in response to a torsion applied to one end of the drive member. An electronically controllable actuator may also be coupled 1010 to the drive member. Rotation 1012 of the actuator in response to an input signal causes rotation of the movable fence members.

The foregoing description of the exemplary embodiments of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather determined from the claims appended hereto

What is claimed is:

1. A fencing section that is capable of being adapted for varying conditions of use comprising:

first and second support rails, wherein the first support rail has a longitudinal void;

a plurality of balusters having rectangular cross-sections and including a first face surface and an oppositely disposed second face surface, wherein the plurality of balusters are oriented perpendicular to the first and second support rails;

a plurality of pivot members releasably fastened to ends of the plurality of balusters to pivotally connect the plurality of balusters to the first and second support rails;

a drive train disposed in the longitudinal void of the first support rail, the drive train including drive gears, idler gears, and a slip mechanism, wherein each of the drive gears is coupled to at least one of the plurality of pivot members, wherein an odd number of idler gears are disposed between adjacent drive gears, and wherein the slip mechanism limits the torque applied to the plurality of balusters;

a drive motor coupled to the drive train, wherein the drive motor is selectively operated to simultaneously rotate the plurality of balusters using the drive train, wherein the drive motor is selectively operated to rotate the plurality of balusters between a plurality of stationary positions including at least an open position, a closed position, and an intermediate position; and an input device that receives an input from a user and controls the operation of the drive motor to selectively rotate the plurality of balusters between the plurality of positions based on the input.

2. The fencing system of claim 1, wherein the respective longitudinal axes of the first and second support rails are horizontally oriented, and the respective vertical axes of the plurality of rotatable balusters are vertically oriented.

3. The fencing system of claim 2, wherein the first support rail is above the second support rail.

4. The fencing system of claim 1, wherein each of the drive gears is fixably coupled to one of the balusters by one of the pivot members, and wherein the idler gears are rotatably coupled to the first support rail.

5. The fencing system of claim 1, further comprising a flexible rotational drive member coupled between the drive motor and the drive train.

6. The fencing system of claim 5, wherein the flexible rotational drive member comprises a flex shaft, wherein the flex shaft comprises a miter gear that translates rotational motion about a first axis of the flex shaft into rotational motion about a second perpendicular axis of the drive gears.

7. The fencing system of claim 1, further comprising a structural support member that encloses the drive motor.

8. The fencing system of claim 1, wherein the drive motor is an electric motor.

9. A fencing section that is capable of being adapted for varying conditions of use comprising:

first and second support rails, wherein the first support rail has a longitudinal void;

a plurality of balusters having a first face surface and an oppositely disposed second face surface, wherein the plurality of balusters are oriented perpendicular to the first and second support rails;

a plurality of pivot members releasably fastened to ends of the plurality of balusters to pivotally connect the plurality of balusters to the first and second support rails;

a drive train disposed in the longitudinal void of the first support rail, the drive train including drive members and idler members, wherein each of the drive members is coupled to at least one of the plurality of pivot members, and wherein an odd number of idler members are disposed between adjacent drive members;

a drive mechanism coupled to the drive train, wherein the drive mechanism is selectively operated to simultaneously rotate the plurality of balusters using the drive train, wherein the drive mechanism is selectively operated to rotate the plurality of balusters between a plurality of stationary positions including at least an open position, a closed position, and an intermediate position; and an input mechanism in communication with the drive mechanism, wherein the input mechanism receives an input from a user and selectively controls the drive mechanism to rotate the plurality of balusters between the plurality of positions based on the input.

10. The fencing section of claim 9, further comprising an end cap configured to be fastened to an end of the first support rail for mounting the support rail to a support post, wherein the end cap is adjustable to permit the fencing section accommodate varying post-to-post distances.

11. The fencing section of claim 10, further comprising a sealing member configured to fill a gap between one of the balusters and the support post, wherein the sealing member is adjustable to accommodate varying post-to-post distances.

12. The fencing system of claim 9, wherein the drive mechanism comprises a plurality of rubber wheels disposed along the longitudinal void of the first support rail.

13. The fencing system of claim 12, further comprising a slip mechanism coupled between the drive mechanism and the plurality of rotatable balusters, wherein the slip mechanism decouples the plurality of rotatable balusters from the drive mechanism when a force between the plurality of rotatable balusters and the drive mechanism exceeds a threshold amount.

14. The fencing system of claim 9, further comprising an electrically controllable actuator coupled to the drive mechanism that causes rotation of the plurality of rotatable balusters in response to an input signal.

15. The fencing system of claim 9, wherein the input mechanism is a manual hand crank.

16. A fencing system that is capable of being adapted for varying conditions of use comprising:

a plurality of fencing sections defining a boundary;

one or more vertical support posts, wherein each of the one or more vertical support posts is fastened to at least one of the plurality of fencing sections;

one or more coupling members, each of which is disposed through one of the one or more vertical support posts wherein each coupling member engages two of the plurality of fencing sections such that the plurality of fencing sections are simultaneously operated; each of the plurality of fencing section comprising:

first and second support rails, wherein the first support rail has a longitudinal void that receives at least one of the one or more coupling members, the first and second support rails being fastened to at least one of the one or more vertical support posts;

a plurality of balusters having a first face surface and an oppositely disposed second face surface, wherein the plurality of balusters are oriented perpendicular to the first and second support rails;

a plurality of pivot members releasably fastened to ends of the plurality of balusters to pivotally connect the plurality of balusters to the first and second support rails;

a drive train disposed in the longitudinal void of the first support rail wherein the drive train is coupled with at least one of the one or more coupling members, the drive train including drive members and idler members wherein each of the drive members is coupled to at least one of the plurality of pivot members, and wherein an odd number of idler members are disposed between adjacent drive members;

a drive mechanism coupled to the drive train of at least one of the plurality of fencing sections, wherein the drive mechanism is selectively operated to simultaneously rotate the plurality of balusters of the plurality of fencing sections using each drive train of the plurality of fencing sections, wherein the drive mechanism is selectively operated to rotate the plurality of balusters of the plurality of fencing sections between a plurality of stationary positions including at least an open position, a closed position, and an intermediate position; and an input mechanism in communication with the drive mechanism, wherein the input mechanism receives an input from a user and selectively controls the drive mechanism to rotate the plurality of balusters of the plurality of fencing sections between the plurality of positions based on the input.

17. The fencing system of claim 16, wherein the one or more coupling members comprise a flexible shaft.

18. The fencing system of claim 17, wherein the flexible shaft comprises a miter gear that translates rotational motion about a first axis of the flex shaft into rotational motion about a second perpendicular axis of the drive members.

19. The fencing system of claim 16, wherein the first support rail and the second support rail have a curved profile.

* * * * *